US007992721B2

(12) United States Patent
McMasters

(10) Patent No.: US 7,992,721 B2
(45) Date of Patent: Aug. 9, 2011

(54) METHOD AND APPARATUS FOR CONFIRMING THAT A FILTER DRIER HAS BEEN REPLACED

(75) Inventor: Mark McMasters, Owatonna, MN (US)

(73) Assignee: SPX Corporation, Charlotte, NC (US)

( * ) Notice: Subject to any disclaimer, the term of this patent is extended or adjusted under 35 U.S.C. 154(b) by 936 days.

(21) Appl. No.: 11/902,250

(22) Filed: Sep. 20, 2007

(65) Prior Publication Data

US 2009/0078642 A1 Mar. 26, 2009

(51) Int. Cl.

| | |
|---|---|
| ***B01D 35/157*** | (2006.01) |
| ***F16L 37/28*** | (2006.01) |
| ***F25B 43/00*** | (2006.01) |
| *B01D 35/00* | (2006.01) |
| *B01D 35/02* | (2006.01) |
| *F25D 19/00* | (2006.01) |

(52) U.S. Cl. ..... 210/435; 210/429; 210/235; 62/299; 62/298; 137/558; 251/149.6

(58) Field of Classification Search ..... None
See application file for complete search history.

(56) References Cited

U.S. PATENT DOCUMENTS

| | | | | |
|---|---|---|---|---|
| 5,150,577 | A * | 9/1992 | Mitchell et al. | 62/636 |
| 2004/0011983 | A1* | 1/2004 | Maiville et al. | 251/149.6 |
| 2006/0053832 | A1* | 3/2006 | Ballet et al. | 62/503 |

OTHER PUBLICATIONS

U.S. Appl. No. 11/477,585, filed Jun. 30, 2006, Bakker, et al.
U.S. Appl. No. 11/709,825, filed Feb. 23, 2007, Chaudhry.
Robinair®; Operating Manual for Model 34788, Recovery, Recycling, Recharging Unit; 2006 SPX Corporation (Rev. A, Nov. 30, 2006), whole document.

* cited by examiner

*Primary Examiner* — In Suk Bullock
*Assistant Examiner* — Madeline Gonzalez
(74) *Attorney, Agent, or Firm* — Baker & Hostetler LLP

(57) ABSTRACT

A filter in some embodiments of the invention includes: a housing defining an interior chamber substantially sealed from outside of the housing; a valve located in the chamber biased to a first position where the valve maintains a seal between the interior chamber and outside of the housing; and an anchor fixed to the housing defining a surface for a spring to urge against and bias the valve to the first position and be compressed against when a receiver enters into the housing a moves the valve to a second position, the anchor defining, at least in part, flow paths wherein a pressurized fluid within the housing can communicate with an interior of the receiver to equalize a pressure within the chamber and the interior of the receiver; and a nipple attached to the housing having an interior passageway configured to permit the receiver to pass through in a substantially sealed manner. A method of attaching a filter to a filter receiver is also provided.

15 Claims, 2 Drawing Sheets

METHOD AND APPARATUS FOR CONFIRMING THAT A FILTER DRIER HAS BEEN REPLACED

FIELD OF THE INVENTION

The present invention relates generally to an apparatus for processing air-conditioning refrigerant. More particularly, the present invention relates to a method and apparatus that identifies whether a filter dryer for refrigerant processing machine has been replaced.

BACKGROUND OF THE INVENTION

Filter dryers in refrigerant recovery units are used to trap acid, moisture, or particulates as the refrigerant passes through the filter dryers. These filter dryers, typically, have a maximum capacity to trap these contaminants. In order for the refrigerant recovery unit to function properly, these filter dryers need to be replaced periodically to ensure the refrigerant is cleaned upon the recovery/recycle process. Otherwise, continued use of the saturated filter dryers can be damaging to the air conditioning system.

Currently, a user is prompted to change the filter dryer when a predetermined amount of refrigerant has passed through the filter dryer, such as one-hundred and fifty pounds. However, the user may simply ignore the notification by pushing a button indicating that he has changed the filter dryer and continues to use the expired filter dryer for the recovery/recycle process. Furthermore, the counter will reset to zero and the notification will not be activated until another one-hundred and fifty pounds of refrigerant has passed through the filter dryer. Thus, the refrigerant passing through the filter dryer will not be cleaned properly upon the recovery/recycle process.

Accordingly, it is desirable to provide a method and apparatus to ensure that a user performs filter dryer maintenance for a refrigerant recovery unit when the filter dryer needs to be replaced.

SUMMARY OF THE INVENTION

The foregoing needs are met, to a great extent, by the present invention, wherein in some embodiments provides a method and apparatus to ensure that a user performs filter dryer maintenance for a refrigerant recovery unit when the filter dryer needs to be replaced.

In accordance with one embodiment of the present invention, a filter is provided. In some embodiments of the invention, the filter includes a housing defining an interior chamber substantially sealed from outside of the housing, a valve located in the chamber biased to a first position where the valve maintains a seal between the interior chamber and outside of the housing, an anchor fixed to the housing defining a surface for a spring to urge against and bias the valve to the first position and be compressed when a receiver enters into the housing and moves the valve to a second position, the anchor defining, at least in part, flow paths wherein a pressurized fluid within the housing can communicate with an interior of the receiver to equalize a pressure within the chamber and the interior of the receiver and a nipple attached to the housing having an interior passageway configured to permit the receiver to pass through in a substantially sealed manner.

In accordance with another embodiment of the present invention, a method of attaching a filter to a filter receiver is provided. In some embodiments of the invention, the method includes opening a valve with a receiver, equalizing a pressure between an interior of the filter and an interior of the receiver, sensing the equalized pressure, transmitting a signal associated with the equalized pressure to a controller, and permitting function of a fluid processor if the signal is indicative of an acceptable pressure.

In accordance with yet another embodiment of the present invention, a filter system is provided. In accordance with some embodiments of the invention, the filter includes means for containing a pressure within an interior chamber, means for valving the interior chamber biased to a first position the valving means maintains a seal between the interior chamber and outside of the chamber, means for anchoring the valving means, means for biasing the valving means to the first position and be moved to a second position when a receiver enters into the chamber, the anchoring means defining, at least in part, flow paths wherein a pressurized fluid within the chamber can communicate with an interior of the receiver to equalize a pressure within the chamber and the interior of the receiver, and means for connecting the filter to a fluid processor.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
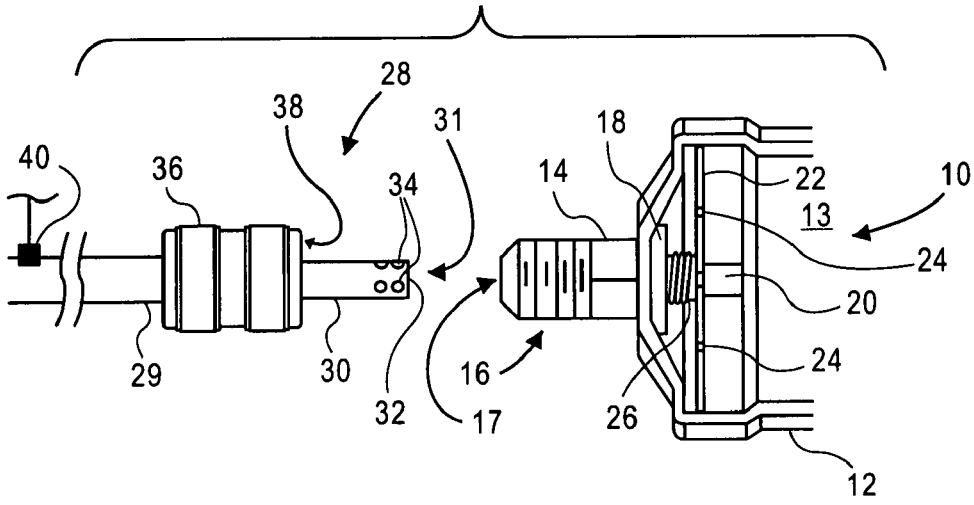
FIG. 1 is a side view of a connector associated with a refrigerant recovery unit and a filter with a portion of the filter's housing cut away to expose interior portions of the filter.
Figure 2:
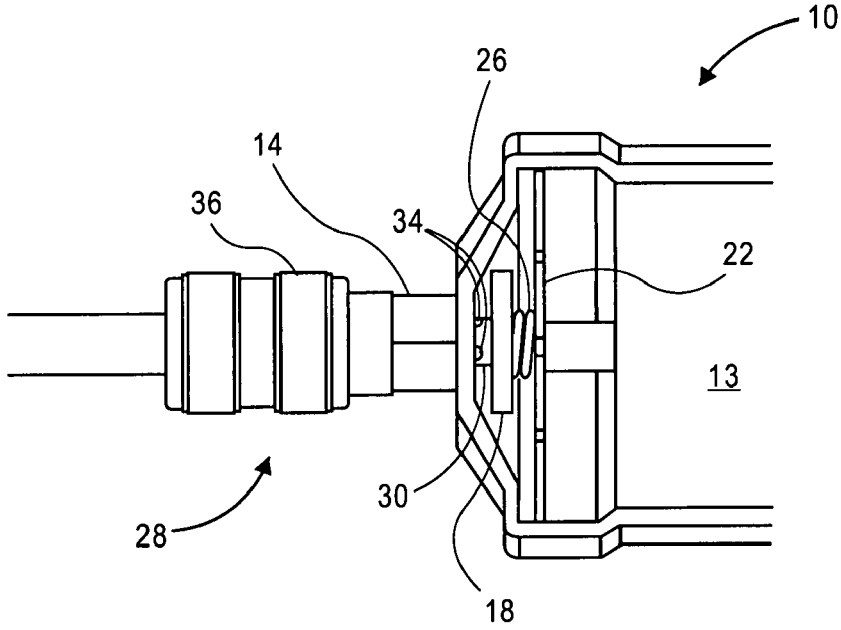
FIG. 2 is a side view of a filter receiver engaged with a filter dryer having a portion of the housing on the filter dryer removed in order to illustrate interior portions of the filter dryer.

The invention will now be described with reference to the drawing figures, in which like reference numerals refer to like parts throughout. An embodiment in accordance with the present invention as shown in FIG. 1 is a filter dryer 10 for a refrigerant recovery device. The filter dryer 10 includes a filter housing 12. The filter housing 12 (as shown in FIGS. 1 and 2) has been partially cut away so that the interior parts of the filter dryer 10 can be illustrated. The filter dryer 10 includes filter media which is configured to filter out particulate matter and also moisture from a refrigerant being processed by a refrigerant recovery device.

Because as moisture is removed, in some embodiments of the invention, the filter referred is sometimes referred to as a filter dryer rather than solely as a filter. In other embodiments and accordance of the invention, drying function may not necessarily be performed. For the purpose of this document, the term filter and the term filter dryer are intended to the interchangeable and not necessarily to limiting the function of a device in accordance with the invention.

The filter 10 (as shown in FIGS. 1 and 2) is a partial view of the filter 10. The filter 10 includes an interior portion 13. The interior portion 13 is contained within the filter housing 12. Located on the filter housing 12 is a nipple 14. The nipple 14 has exterior threads 16. The nipple 14 defines an interior passageway 17.

The passageway 17 is open at one end of the nipple 14 and extends longitudinally through the nipple 14 and is terminated by a valve 18. The valve 18 when in a closed position, prevents fluid communication between the interior 13 of the filter 10 and the passageway 17. The valve 18 has a valve shaft 20. In some embodiments of the invention, the valve 18 and the valve shaft 20 are one unitized part. In other embodiments of the invention, the valve 18 and the valve shaft 20 may be comprised of two different parts. In some embodiments of the invention, the valve 18 is stainless steel.

A plate 22 is located in the interior 13 of the filter 10. The plate 22 is fixed or attached to the housing 12. The plate 22 includes holes 24 which provide passageways for fluid to flow from one side of the plate 22 to the other side of the plate 22. The plate 22 provides an anchor for the spring 26 to urge against.

The spring 26, in some embodiments of the invention, is a coil spring located around the valve shaft 20. The spring 26 urges against the plate 22 on one end and against the valve 18 at the other end. The spring 26 biases the valve 18 to a closed position. The valve 18 creates a seal between the interior portion 13 of the filter 10 and the interior passageway 17 through the nipple 14. In some embodiments of the invention, the valve 18 may include an O ring, gasket, resilient material or other similar structure to facilitate sealing the passageway 17 from the interior 13 of the filter 10.

The left side of FIG. 1 illustrates a filter receiver 28. The filter receiver 28 includes a tube portion 29. In some embodiments of the invention, the tube 29 may be copper. In other embodiments of the invention, other metals or materials may be used. The tube 29 includes a tube end 30. The tube 29 has an interior space 31 running the length of the tube 29.

The tube end 30 has an open end 32 providing fluid communication between interior 31 of the tube 29 and the ambient conditions outside of the tube 29. The open end 32 also includes side holes 34 which also provide fluid communication between the ambient conditions outside the tube 29 and the interior 31 of the tube 29. Thus, fluid communication can occur between the interior 31 of the tube 29 either through the open end 32 or the side holes 34.

Mounted on the tube 29 is a swivel nut 36. The swivel nut 36, in some embodiments of the invention, contains internal threads 38. The interior threads 38 of the swivel nut 36 are configured to attach to the exterior threads 16 of the nipple 14 as shown and described in more detailed below with respect to FIG. 2.

A sensor 40 is in communication with the interior 31 of the tube 29. The sensor 40 may be located anywhere along the tube 29. The sensor 40 is configured to detect pressure of fluid within the interior portion 31 of the tube 29.

Turning now to FIG. 2, FIG. 2 illustrates the filter dryer 10 mechanically connected to the filter receiver 28. The interior 13 of the filter 10 is fluidly connected to the interior 13 of the tube 29.

As shown in FIG. 2, the tube end 30 has passed through the interior passageway 17 contained in the nipple 14 so that the tube end 30 has pressed against the valve 18 and moved the valve 18 against the force of the spring 26. The valve 18 has been lifted from its seated sealing position. The tube end 30 is now physically located in the interior 13 of the filter 10. Fluid communication is now accomplished between the interior 13 of the filter 10 and the interior 31 of the tube 29 via the passageways in the plate 24 and the side holes 34 and the open end 32.

In some embodiments of the invention, the open end 32 of the tube end 30 may be somewhat hindered or blocked by the valve 18. Thus, the side holes 34 provide unimpeded fluid communication between the interior 13 of the filter 10 and the interior 31 of the tube 29. To secure the filter dryer 10 on to the filter receiver 28, the swivel nut 36 may be turned to cause the internal threads 38 to engage and communicate with the external threads 16 on the nipple 14 to secure the filter 10 on to the filter receiver 28 (as shown FIG. 2).

Figure 3:
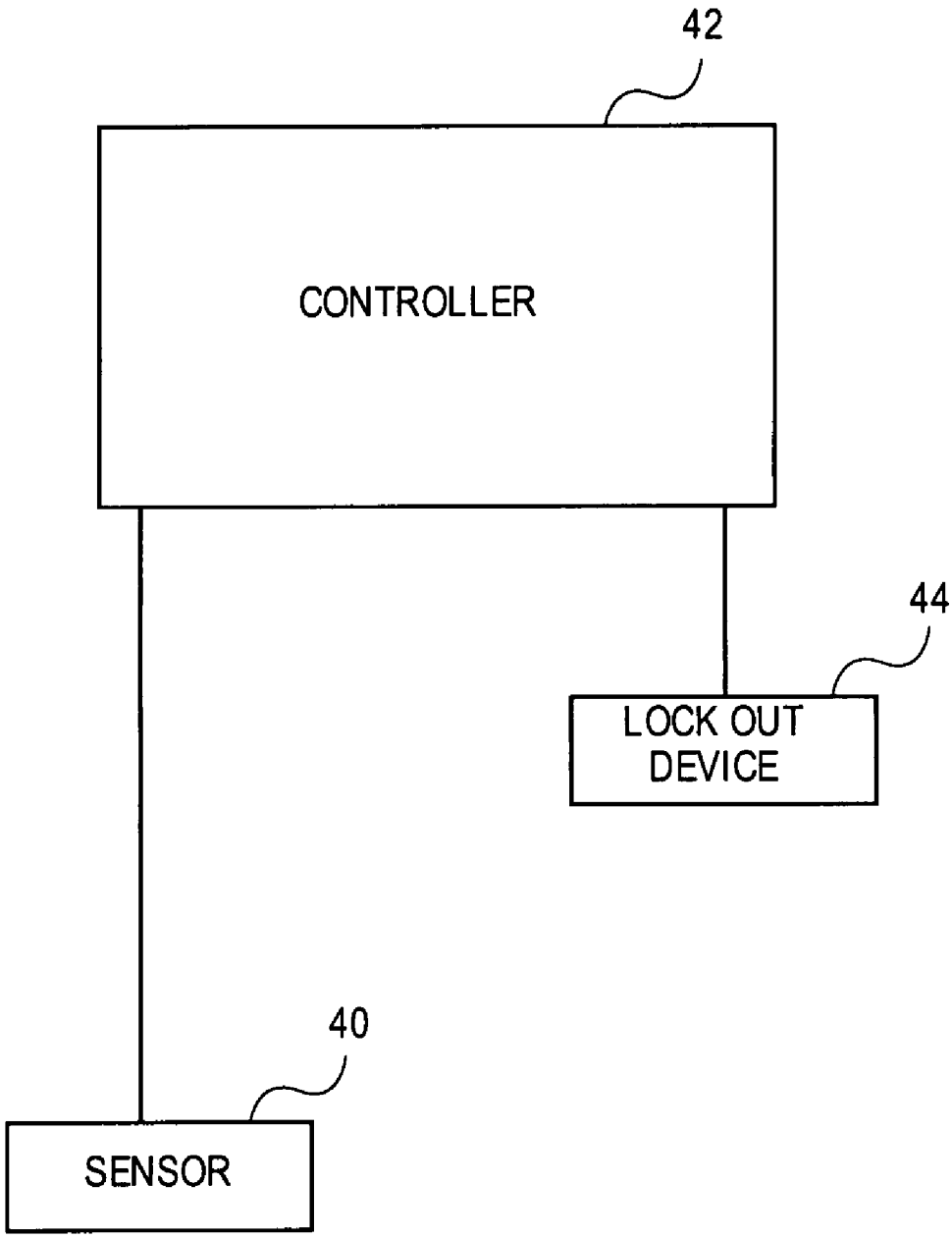
FIG. 3 is a schematic diagram of a portion of a refrigerant recovery device including a pressure sensor, a controller, and a lock out device.

Tuning now to FIG. 3. FIG. 3 illustrates a schematic diagram according to one embodiment of the invention. The schematic diagram shows a controller 42 that is operatively connected to the sensor 40. As mentioned above, the sensor 40 is configured to sense a fluid pressure within the interior 31 of the tube 29. The controller 42 is also operatively connected a lock out device 44. In some embodiments of the invention, the lock out device 44 may actually be part of the controller 42.

In some embodiments of the invention, the lock out device 44 may be software programmed onto the controller 42. The controller 42 may be, in some embodiments of the invention, a microprocessor.

According to some embodiments of the invention, the controller 42 can be configured to monitor how much refrigerant has been processed by a refrigerant recover unit. When the refrigerant recovery unit has processed a certain amount of refrigerant (for example, in some embodiments a 150 pounds of refrigerant) the controller 42 may be programmed to engage the lock out device 44 so the refrigerant recovery device will not function until the filter 10 has been replaced. Such a lock out feature ensures that a filter 10 is replaced at regular intervals.

In some embodiments of the invention, the filter interior 13 is given a predetermined amount of fluid pressure. In some embodiments of the invention, the fluid pressure is a positive pressure, or in other words exceeds atmospheric or ambient conditions outside the filter.

When in some embodiments of the invention, a preset amount of fluid, has been processed, the controller 42 will engage the lock out procedure 44 which stops or reduces the operation of the refrigerant recovery device until a new filter 10 has been replaced onto the filter receiver 28.

In order to change the filter 10 from the filter receiver 28, the interior 31 of the tube 29 is evacuated to remove the refrigerant. The filter 10 then is removed by loosening the swivel nut 36 and removing the tube end 30 from the interior passageway 17 of the nipple 14. At such time, the pressure within the interior 31 of the tube 29 will equalize with the ambient air conditions outside of the interior 31 of the tube 29 because free fluid communication can occur between the interior 31 of the tube 29 and the ambient conditions outside of the filter receiver 28.

According to some embodiments of the invention, a signal associated with the pressure of the evacuated interior 31 of the tube 29 is supplied to the controller 42 as sensed by the sensor 40. When the filter 10 is removed, the equalization of the pressure inside the interior 31 of the tube 29 with the ambient air is also sensed by the sensor 40 and reported to the controller 42.

Finally, once the new filter 10 has been installed onto the filter receiver 28 and the fluid pressure within the interior 13 of the filter 10 equalizes with the interior 31 of the tube 29. This equalized pressure as sensed by the sensor 40 is then reported to the controller 42. Different pressures or pressure ranges associated with each of the different steps: evacuating the interior of the tube 31; equalizing the interior 31 of the tube 29 with the ambient air conditions and then equalizing the interior 31 of the tube 29 with the interior 13 of the filter 10 are reported by the sensor 40 to the controller 42.

Some embodiments in accordance with the invention do not monitor the pressure at all of the aforementioned times but rather, the pressure sensor 40 reports the pressure with the interior 31 of the tube 29 once the new filter 10 has been placed on the filter receiver 28. Once this pressure is reported to the controller 42 and it is within a predetermined range, the controller 42 disengages the lock out feature 44 and permits operation of the fluid processing unit.

In some embodiments of the invention, existing recovery units can be modified to have new software programmed onto the controller 42 and the filtering receiver 28 can be modified in accordance of the invention. In other embodiments of the invention, current designs of recovery recycling recharging units can be modified so that future built units will have the controller programmed to control software that will operate the lock out feature 44 as described herein. In addition, the recovery unit will be equipped with a filter receiver 28 with filter 10 in accordance with the invention.

An example of a recovery recycle recharging unit that can be modified to have a controller, a sensor, and lock out feature along with a filter receiver and filter dryer in accordance with the invention, is the recovery recycle recharging unit that is currently sold by the SPX Corporation under the tradename ROBINAIR and identified as the model 34788. After reviewing the disclosure contained herein, one skilled in the art could modify such a refrigerant recovery unit such as the ROBINAIR model 34788 or other similar refrigerant recovery units to be in accordance of the invention.

Another refrigerant recovery unit that can be modified to be in accordance with the invention is a recovery unit as described in U.S. patent application Ser. No. 11/709,825; titled, Component Identification System and Method; filed Feb. 23, 2007; with Raheel Ashraf Chaudhry listed as the inventor, the disclosure of which is incorporated herein by reference in its entirety.

Another refrigerant recovery unit that may be modified to be in accordance with the invention is a recovery unit as described in U.S. patent application Ser. No. 11/477,585; titled, Method and Apparatus For Refrigerant Recovery Unit Filter Dryer Maintenance; filed Jun. 30, 2006; having Travis Bakker and Gary Murray listed as the inventors, the disclosure of which is incorporated herein by reference in its entirety.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A filter, comprising:

a housing defining an interior chamber substantially sealed from outside of the housing;

a valve located in the chamber biased to a first position where the valve maintains a seal between the interior chamber and outside of the housing;

an anchor fixed to the housing defining a surface for a spring to urge against and bias the valve to the first position and be compressed when a receiver enters into the housing and chamber and moves the valve to a second position, the anchor defining, at least in part, flow paths wherein a pressurized fluid within the housing can communicate with an interior of the receiver to equalize a pressure within the chamber and the interior of the receiver; and a nipple attached to the housing having an interior passageway configured to permit the receiver to pass through in a substantially sealed manner.

2. The filter of claim 1, wherein the valve is a T shaped valve.

3. The filter of claim 2, wherein the spring is coiled around a shaft portion of the T, the cross portion of the T plugs a hole in the housing when the valve is in the first position.

4. The filter of claim 1 further comprising external threads on the nipple.

5. The filter of claim 4 further comprising a tubular receiver configured to receive the filter by entering the nipple and a swivel nut on the tubular receiver having interior threads wherein the filter and the receiver lock together by the interior threads on the swivel nut communication with the external threads on the nipple.

6. The filter of claim 1, wherein the chamber is pressurized to a positive pressure with respect to ambient conditions to the filter.

7. The filter of claim 1 further comprising:

a fluid processor having a receiver that receives the filter, the receiver further comprising:

a tube having an interior configured to enter the nipple and push the valve to the second position.

8. The filter of claim 7 further comprising cross holes in the tube to permit fluid to equalize pressure within the interior of the tube and the chamber.

9. The filter of claim 7 further comprising a pressure sensor fluidly connected to the interior of the tube for sensing a fluid pressure inside the interior of the tube.

10. The filter of claim 9 further comprising a controller operatively connected to the sensor and configured to monitor a pressure sensed by the sensor.

11. The filter of claim 10, wherein the fluid processor includes a lock out feature that will disable the function of the fluid processor unless a pressure within a predetermined range is sensed by the sensor and reported to the controller.

12. A filter system comprising:

means for containing a pressure within an interior chamber;

means for valving the interior chamber biased to a first position where the valving means maintains a seal between the interior chamber and outside of the chamber;

means for anchoring the valving means;

means for biasing the valving means to the first position and be moved to a second position when a receiver enters into the chamber, the anchoring means defining, at least in part, flow paths wherein a pressurized fluid within the chamber can communicate with an interior of the receiver to equalize a pressure within the chamber and the interior of the receiver; and means for connecting the filter to a fluid processor.

13. The filter of claim 12 further comprising a fluid processor including a means for sensing an equalized pressure within the interior chamber and a controller for receiving a signal from the means for sensing.

14. The filter of claim 13 further comprising a lock out feature associated with the fluid processor and configured to disable the fluid processor when the fluid processor has processed a predetermined amount of fluid and the lock out feature is configured to permit the fluid processor to operate when the controller receives a signal from the means for sensing corresponding to a predetermined equalized pressure range.

15. The filter of claim 13, wherein the predetermined amount of fluid is about 150 pounds.

* * * * *